United States Patent [19]

Trinkwalder, Jr.

[11] 4,356,820

[45] Nov. 2, 1982

[54] HEAT RECLAIMER FOR DEMAND REGULATOR

[75] Inventor: Joseph C. Trinkwalder, Jr., North Tonawanda, N.Y.

[73] Assignee: Sherwood-Selpac Corporation, Lockport, N.Y.

[21] Appl. No.: 178,690

[22] Filed: Aug. 18, 1980

[51] Int. Cl.[3] ..... A62B 7/04

[52] U.S. Cl. ..... 128/204.26; 128/201.13; 137/334; 137/DIG. 9

[58] Field of Search ..... 128/204.26, 204.27.201.13, 128/204.13, 201.28, 204.17, 204.18, 205.24, 207.12; 137/334, DIG. 9

[56] References Cited

U.S. PATENT DOCUMENTS

| | | | |
|---|---|---|---|
| 3,747,598 | 7/1973 | Cowans | 128/142 |
| 3,863,459 | 2/1975 | Rein | 62/48 |
| 3,898,978 | 8/1975 | Marcus | 126/204 |
| 4,197,841 | 4/1980 | Brauer et al. | 128/201.13 |
| 4,214,580 | 7/1980 | Pederson | 128/204.26 |

*Primary Examiner*—Henry J. Recla
*Attorney, Agent, or Firm*—Christel, Bean & Linihan

[57] ABSTRACT

A demand regulator for use in breathing apparatus including a housing, a diaphragm in the housing separating the interior into a first chamber in communication with the ambient and a second chamber, a breathing passage for the user in communication with the second chamber, a valve controlling the supply of pressure to the second chamber and a valve actuator connected to the valve and operatively associated with the diaphragm for operating the valve in response to changes in the pressure differential between the first and second chambers. At least one heat conducting element is located in the second chamber and has a first portion located to receive heat from the user's breath and a second portion in heat transferring relation to the connection of the actuator to the valve whereby heat is transferred from the user's breath to the valve and connection to the valve actuator for preventing freeze-up of the valve and actuator under cold ambient conditions.

10 Claims, 6 Drawing Figures

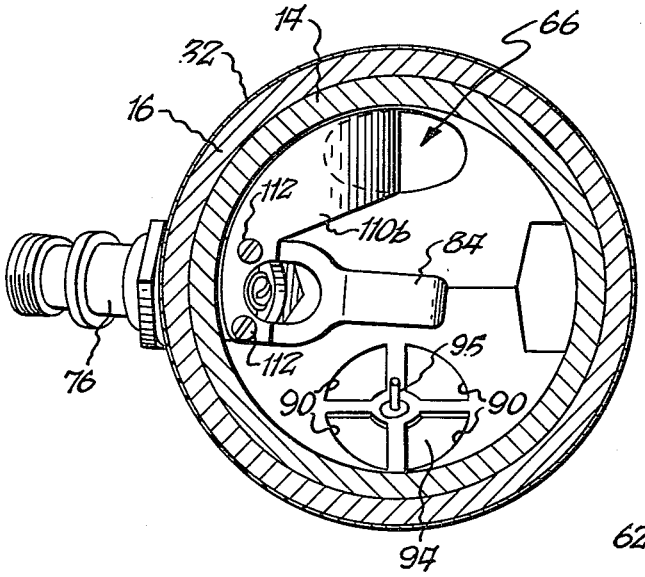
Fig. 3.
Fig. 4.
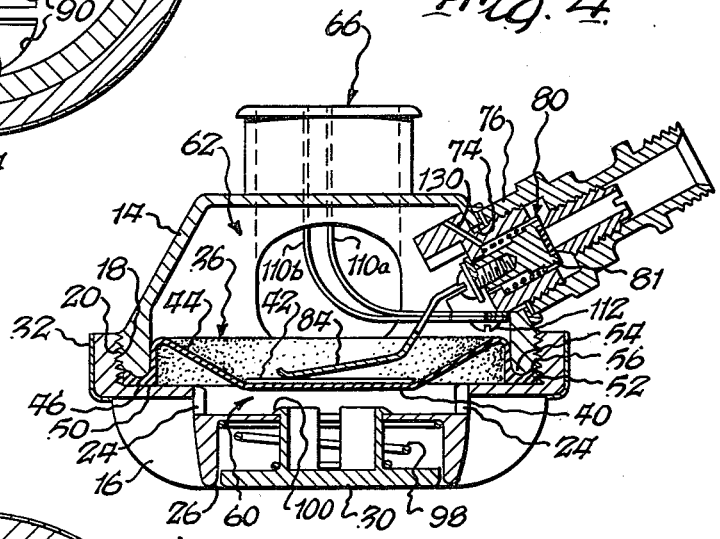
Fig. 5.
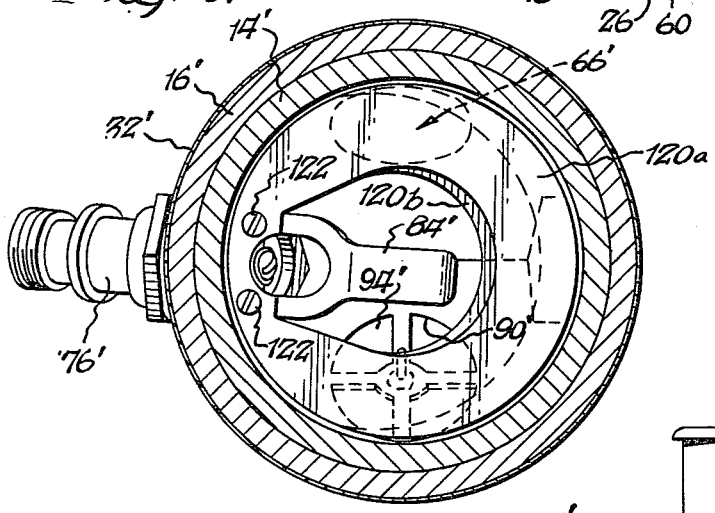
Fig. 6.
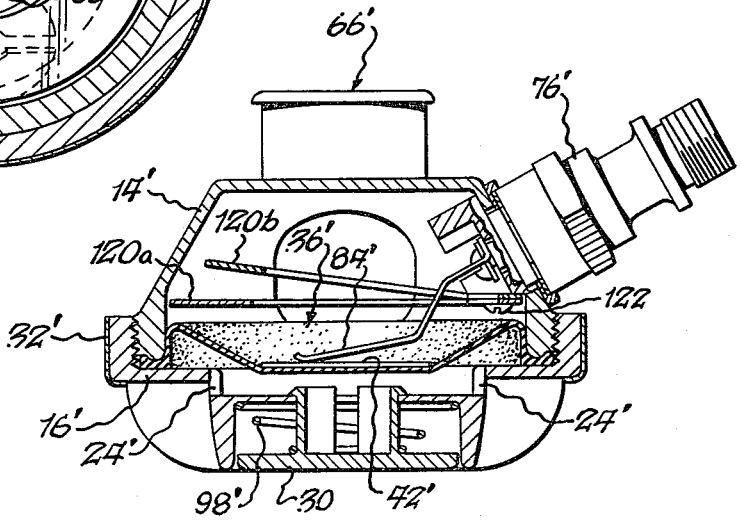

HEAT RECLAIMER FOR DEMAND REGULATOR

BACKGROUND OF THE INVENTION

This invention relates to the art of pressure regulators, and more particularly to a new and improved demand pressure regulator for use in breathing apparatus.

One area of use of the present invention is in underwater breathing apparatus, although the principles of the present invention can be variously applied. A problem encountered by scuba demand regulators is freeze-up in cold water. In particular, warm moist air from the diver's mouth creates condensed water inside the regulator housing which contains the regulator supply valve and valve actuating lever. In cold water environments, the temperature of the supply valve may drop below freezing causing freeze-up of the connection between the valve and actuating lever. This, in turn, will cause a free flow, i.e. non-regulating, condition in the regulator.

SUMMARY OF THE INVENTION

It is, therefore, a primary object of this invention to provide a new and improved demand pressure regulator for use in breathing apparatus.

It is a more particular object of this invention to provide such a regulator wherein freeze-up of the internal valve mechanism is prevented during cold ambient conditions.

It is a further object of this invention to provide such a regulator which is simple in construction and reliable in operation.

The present invention provides a demand regulator for use in breathing apparatus including a housing, a diaphragm in the housing separating the interior into a first chamber in communication with the ambient and a second chamber, a breathing passage for the user in communication with the second chamber, and a valve mechanism for controlling the supply of pressure to the second chamber comprising a valve and a valve actuator operatively connected to the valve and operatively associated with the diaphragm for operating the valve in response to changes in the pressure differential between the first and second chambers. At least one heat conducting element is in the second chamber and has a first portion so located to receive heat from the user's breath and a second portion in heat transferring relation to the valve mechanism whereby heat is transferred from the user's breath to the valve mechanism for preventing freeze-up of the valve mechanism under cold ambient conditions.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 3 is a sectional view thereof taken about on line 3—3 in FIG. 2;

FIG. 4 is a sectional view thereof taken about on line 4—4 in FIG. 1;

FIG. 5 is a sectional view similar to FIG. 3 illustrating a regulator according to another embodiment of the present invention; and FIG. 6 is a sectional view similar to FIG. 4 further illustrating the embodiment of FIG. 5.

DETAILED DESCRIPTION OF THE ILLUSTRATED EMBODIMENTS

In a basic pressure regulator for use in breathing apparatus, an internal diaphragm divides the housing interior into a first chamber open to ambient and a second chamber, a breathing passage leads from the second chamber and is adapted to be in communication with the mouth of the user for breathing therethrough, a supply passage leads to the second chamber and is adapted for connection to a source of pressure, a valve is in the passage for controlling the supply of pressure to the second chamber, and a valve actuator is connected to the valve and is operatively associated with the diaphragm for operating the valve in response to changes in the pressure differential between the first and second chambers. In accordance with this invention, at least one heat conducting element is provided in the second chamber and has a first portion so located to receive heat from the user's breath and has a second portion in heat transferring relation to the connection of the valve actuator to said valve whereby heat is transferred from the user's breath to the valve and the connection to the valve actuator for preventing freeze-up of the valve and actuator under cold ambient conditions. As a result a free-flow or non-regulating condition is prevented.

Figure 1:
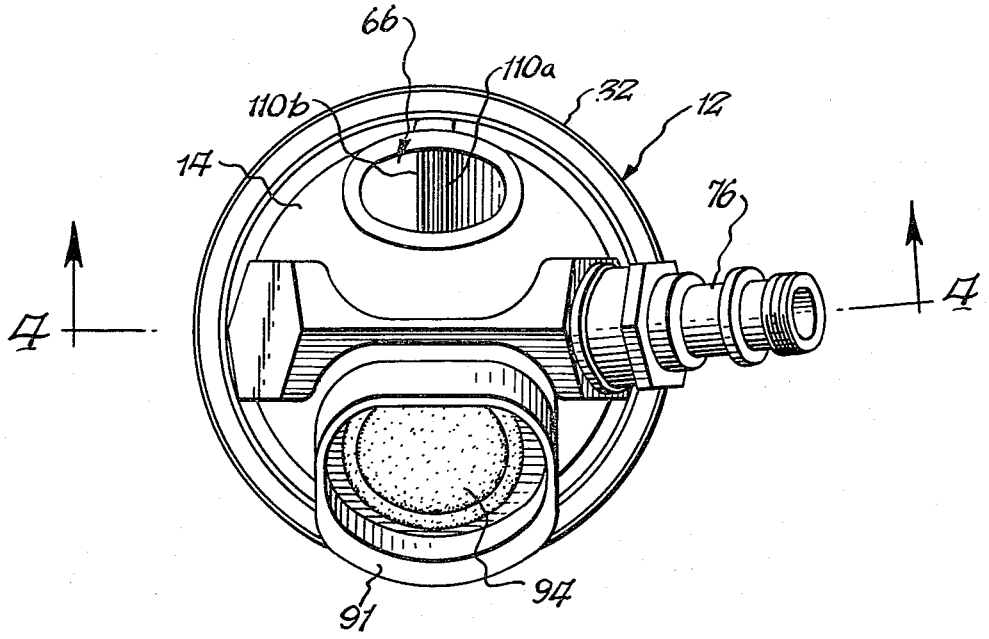
FIG. 1 is a plan view of a demand regulator according to the present invention.
Figure 2:
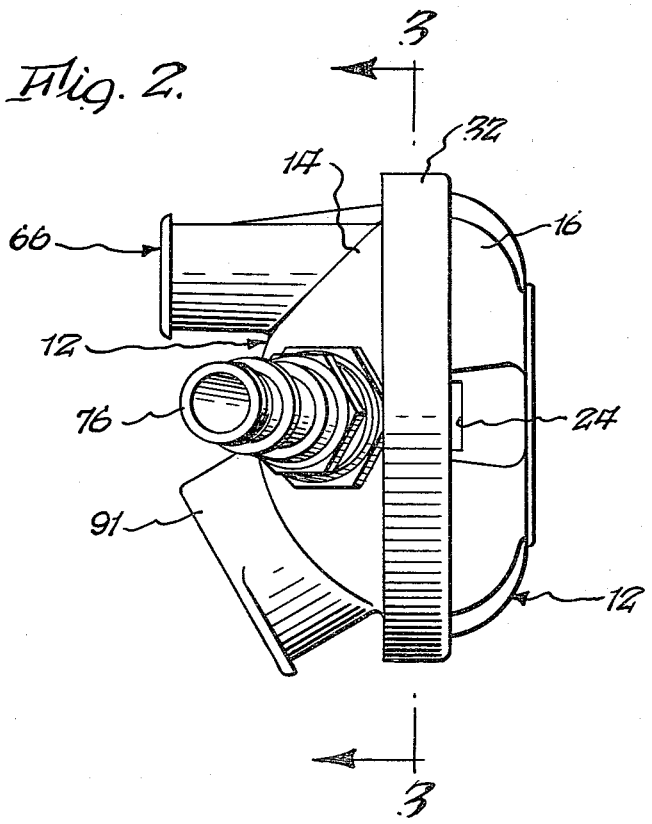
FIG. 2 is an elevational view thereof taken from the right-hand side as viewed in FIG. 1.

Referring now to FIGS. 1–4 the demand regulator according to the present invention comprises a housing generally designated 12 including a main body portion 14 and a cover portion 16 both of molded plastic material and both being somewhat hemispherically shaped. In the device shown, the housing portions are connected by engagement between threads 18 (FIG. 4) on the outer surface of portion 14 and threads 20 on the inner surface of portion 16. In other words, the housing main body portion 14 is simply screwed into the cover portion 16 for convenient and easy assembly and disassembly of the regulator.

The housing cover portion 16 is generally in the form of a cap and is provided with a plurality of openings 24 spaced circumferentially therearound for placing a portion of the housing interior adjacent cover 16 at ambient pressure. The cover 16 is provided with a central aperture 26 for receiving a button 30 which serves as a manual operator element for the regulator in a manner to be described. A circumferential metal band or rim 32 is fitted on the cover 16.

The regulator further comprises a diaphragm generally designated 36 (FIG. 4) within housing 10 and dividing the housing interior into a first chamber open to the ambient and a second chamber. In particular, diaphragm 36 is generally disc-shaped and is of flexible, preferably resilient material such as a suitable rubber. The diaphragm 36 has a central circular portion 40 having a diameter less than the overall diameter of the diaphragm. An element 42 of rigid material such as metal in the shape of a disc is attached, such as by suitable cement, to the circular portion 40 for a purpose to be described. The diaphragm further includes an annular body portion 44 extending from the central portion 40, and the body portion meets an outer peripheral rim portion 46. Rim 46 is annular and has a first axial end face which is flat and abuts against an annular surface or seat 50 formed in cap portion 16. The opposite axial face of rim 46 is formed to include an annular bead 52 which is received in a groove defined between an annular bead formation 54 and a smooth annular surface 56 on the end face of the housing main body portion 14 when the housing portions are screwed together. Thus, diaphragm divides the interior of the regulator housing into a first chamber 60 in fluid communication with the ambient through the openings 24 in cover 16 and a second chamber 62 within the housing main body portion 14.

The regulator according to the present invention further comprises a breathing passage generally designated 66 leading from the second chamber 62 and adapted to be in communication with the mouth of the user for breathing therethrough. In the device shown, passage 66 is located on housing 10 generally opposite the button 30 and offset from the center of chamber 62. Passage 66 is in the form of a conduit formed integrally with housing portion 14 and which extends a short distance out from the housing wall. Passage 66 can have various cross sectional shapes, and in the device shown the cross section of passage 66 is somewhat elliptical. Passage 66 is adapted to be connected to a conventional mouth piece element (not shown) commonly used in breathing apparatus.

The regulator according to the present invention further comprises a supply passage leading to the second chamber 62 and adapted for connection to a source of pressure. The supply passage is defined by an opening 74 in the wall of housing portion 14 and a fitting 76 connected at one end in the opening and extending therefrom for connection at the other end to a supply conduit in the form of a hose (not shown) which, in turn, is connected to a suitable supply of pressure (not shown) in a known manner. The regulator further comprises a valve mechanism including a valve generally designated 80 in the supply passage for controlling the supply of pressure to the second chamber 62. The valve, which can be of various commercially available types, includes a housing which threads into fitting 76 and which includes a spring-loaded valve stem or element 81 located in a longitudinal bore or passage in valve 80. Stem 81 is shown in a closed position having the right-hand end face as viewed in FIG. 4 contacting an internal valve seat to block flow through the valve. Stem 81 is movable to the left as viewed in FIG. 4 against the force of the spring and when unseated opens the internal valve passage for fluid flow therethrough.

The valve mechanism further comprises a valve actuator connected to the valve and operatively associated with the diaphragm for operating the valve in response to changes in the pressure differential between the first and second chambers 60 and 62, respectively. The valve actuator is in the form of a lever 84 of rigid material such as metal connected at one end to the spring-loaded valve stem 81 and extending so that the opposite end thereof operatively engages the diaphragm 36, in particular disc 42 attached to the center of diaphragm 36. Lever 84 is arranged so that upon movement of the disc 42 carried by diaphragm 36 in response to a pressure differential between the chambers 60 and 62 the valve stem 81 is moved to open or close valve 80. In particular, there is an equilibrum position of diaphragm 36 where the pressure on opposite sides thereof is equal and in this condition the disposition of the actuator 84 is to close the valve 80. Upon a decrease in pressure in chamber 62 causing movement of diaphragm 36 into chamber 62, the lever 84 moves in a manner opening in the valve 80. The end of lever 84 is bifurcated in a generally U-shaped formation and the two arms are fitted under the head of a screw which is threaded into the left-hand end of valve stem 81 as viewed in FIG. 3. Other valves and arrangements for connecting lever 84 to the valve can be employed to provide the foregoing mode of operation.

The regulator of the present invention further comprises an exhaust passage for placing housing portion 62 in communication with the ambient under certain conditions. In particular, the exhaust passage comprises a plurality of openings 90 in the wall of housing portion 14 in communication with a short tube 91 leading from the housing, and these openings are normally closed by means of a check valve in the form of a flexible element 94, preferably resilient, of rubber or like material. Element 94 is held in place at the center thereof by a stem 95 fitted into an opening in the valve housing. Upon an increase of pressure in chamber 62, the check valve element 94 allows flow of fluid from chamber 62 into the ambient, but the valve element 94 blocks flow from the outside into chamber 62 under any pressure conditions.

As shown in FIG. 4, button 30 is held in a normal, inactive position by spring 98. Upon application of manual force such as by the user's finger, button 30 is moved inwardly against the force of spring 98 and eventually the inner surface 100 of button 30 contacts the surface of diaphragm 36 opposite disc 42 whereupon further inward movement of button 30 moves lever 84 to open valve 80 to admit pressure fluid from the supply to chamber 62 and breathing passage 66. Thus the user has additional, manual control of the supply of air to breathing passage 66.

In accordance with the present invention the regulator is provided with a heat conducting element in the second chamber 62 having a first portion so located to receive heat from the user's breath and having a second portion in heat transferring relation to the valve mechanism whereby heat is transferred from the user's breath to the valve mechanism for preventing freeze-up of the valve mechanism under cold ambient conditions. The heat conducting element is elongated and in the regulator shown in FIGS. 1–4 the heat conducting element has one end connected to valve 80 and the other end located in breathing passage 66. Preferably a plurality of heat conducting elements are provided, and in the regulator of FIGS. 1–4 two heat conducting elements **110*a*, 110*b* are included. In particular, each heat conducting element 110*a*, 110*b* is in the form of a thin strip of heat conducting metal such as copper. The strips 110*a*, 110*b* are joined together each at one end and to the outer body surface of valve 80 by suitable means such as screw fasteners 112. In addition, the strips 110*a*, 110*b* are joined to valve 80 adjacent the location where actuator lever 84 is connected to valve 80. Each strip 110*a*, 110*b* in the regulator of FIGS. 1–4 extends in a first direction away from valve 80 and substantially parallel to the plane of diaphragm portion 40 and then in a second direction into breathing passage 66. As the strips extend into breathing passage 66 they are separated by a small distance therebetween so that both surfaces of each strip are exposed to heat of the user's breath in passage 66**.

In operation, during use of the regulator when the user exhales into breathing passage 66, the heat from his exhaled breath is transferred or conducted by the elements 110*a*,110*b* to valve body 80. This transferred, reclaimed heat applied to valve 80 adjacent the connection of valve actuator raises the temperature of the valve mechanism above freezing and prevents freeze-up of the valve mechanism during cold operating conditions. In underwater breathing apparatus, for example, the cold water can lower the temperature of the valve mechanism below freezing. Warm, moist air from the diver's mouth creates condensed water inside the regulator housing. This can freeze the valve mechanism in an open condition causing the regulator to free flow, i.e. not regulate. In addition, continued flow of supply air into the regulator and adiabatic expansion of such air flowing through the valve can lower the temperature of the valve mechanism even more thereby aggravating the problem. In the regulator of the present invention, on the other hand, the heat reclaimed from the user's breath is transferred or conducted to the valve mechanism to keep the temperature of the valve mechanism above freezing thereby avoiding the problem of freeze-up and resulting free flow.

FIGS. 5 and 6 show a regulator according to the present invention wherein components similar to those of the regulator of FIGS. 1–4 are identified by the same reference numeral having a prime designation. In the regulator of this embodiment, the heat conducting element is located entirely within the second chamber, and as in the previous embodiment a plurality of heat conducting elements are employed. In particular, each heat conducting element 120*a*,120*b* is annular in shape, being stamped or otherwise formed out of a thin sheet of heat conducting metal such as copper. Each ring 120*a*,120*b* is secured at one location along its circumference to the body of valve 80' by suitable means such as screw fasteners 122. In addition, the rings 120*a*, 120*b* are joined to valve 80' adjacent the location where actuator lever 84' is connected to valve 80'. The ring 120*a* closest to diaphragm 36' is disposed in chamber 62' in a plane substantially parallel to the plane of diaphragm portion 40'. The other ring 120*b* is disposed at an acute angle to the first ring 120*a*, the angle being described in a direction toward breathing passage 66'. As in the previous embodiments, heat is reclaimed from the exhaled breath of the user and transferred or conducted by elements 120*a*,120*b* to the valve mechanism to keep the temperature of the valve mechanism above freezing.

It is therefore apparent that the present invention accomplishes its intended objects. While several embodiments of the present invention have been described in detail, this is for the purpose of illustration, not limitation.

I claim:

1. In a pressure regulator for use in breathing apparatus wherein said regulator includes a housing, a diaphragm within said housing dividing the housing interior into a first chamber open to ambient and a second chamber, a breathing passage leading from said second chamber and adapted to be in communication with the mouth of the user for breathing therethrough, exhalation valve means operatively associated with said second chamber for exhausting from said second chamber gas exhaled by the user, a supply passage leading to said second chamber and adapted for connection to a source of pressurized gas and a valve mechanism for controlling the supply of pressurized gas to said second chamber comprising a valve in said supply passage having an outlet port leading into said second chamber and a valve actuator connected to said valve and operatively associated with said diaphragm for operating said valve in response to changes in the pressure differential between said first and second chambers, the improvement comprising:

a heat conducting element in said second chamber having a first portion so located to receive heat from the user's breath and having a second portion connected in heat transferring relation to said valve mechanism whereby heat is transferred from the user's breath to said valve for preventing freeze-up of said valve mechanism under cold ambient conditions, said second portion of said heat conducting element having sufficient surface contact with said valve mechanism to transfer heat to said valve in an amount sufficient for preventing said freeze-up, said second portion of said heat conducting element contacting said valve mechanism at a location spaced from said valve outlet port a sufficient distance so as not to influence the flow of pressurized gas from said valve outlet port to said breathing passage and said outlet port of said valve being oriented with respect to said heat conducting element so as to direct the flow of pressurized gas away from said heat conducting element.

2. Apparatus according to claim 1, wherein said heat conducting element is elongated having one end connected to said valve and the other end in said breathing passage.

3. Apparatus according to claim 1 wherein said heat conducting element is of metal.

4. Apparatus according to claim 1 wherein said heat conducting element is annular and located entirely in said second chamber.

5. Apparatus according to claim 1 wherein said second portion of said heat conducting element is in heat transferring relation to the connection of said valve actuator to said valve.

6. In a pressure regulator for use in breathing apparatus wherein said regulator includes a housing, a diaphragm within said housing dividing the housing interior into a first chamber open to ambient and a second chamber, a breathing passage leading from said second chamber and adapted to be in communication with the mouth of the user for breathing therethrough, exhalation valve means operatively associated with said second chamber for exhausting from said second chamber gas exhaled by the user, a supply passage leading to said second chamber and adapted for connection to a source of pressurized gas, and a valve mechanism for controlling the supply of pressurized gas to said second chamber comprising a valve in said supply passage and a valve actuator connected to said valve and operatively associated with said diaphragm for operating said valve in response to changes in the pressure differential between said first and second chambers, the improvement comprising:

a plurality of heat conducting elements in said second chamber each having a first portion so located to receive heat from the user's breath and each having a second portion connected in heat transferring relation to said valve mechanism, said first portions of said elements being in spaced relation, whereby heat is transferred from the user's breath to said valve for preventing freeze-up of said valve mechanism under cold ambient conditions.

7. Apparatus according to claim 6, wherein each of said heat conducting elements is elongated having one end connected to said valve and the other end in said breathing passage.

8. Apparatus according to claim 6, wherein each of said heat conducting elements is of metal.

9. Apparatus according to claim 6, wherein each of said heat conducting elements is annular and located entirely in said second chamber.

10. Apparatus according to claim 6, wherein said second portion of each of said heat conducting elements is in heat transferring relation to the connection of said valve actuator to said valve.

* * * * *